US005496082A

United States Patent [19]

Zuckerman

[11] Patent Number: 5,496,082

[45] Date of Patent: Mar. 5, 1996

[54] INTERCONNECTED LOCK

[75] Inventor: Martin Zuckerman, Villa Park, Calif.

[73] Assignee: Emhart Inc., Newark, Del.

[21] Appl. No.: 359,967

[22] Filed: Dec. 20, 1994

[51] Int. Cl.[6] ..... E05B 3/00

[52] U.S. Cl. ..... 292/336.3; 292/142; 292/172; 292/244

[58] Field of Search ..... 292/140, 143, 292/244, 336.3, 142, 172

[56] References Cited

U.S. PATENT DOCUMENTS

| | | | |
|---|---|---|---|
| 2,442,763 | 6/1948 | Falk . | |
| 2,854,270 | 9/1958 | Ward . | |
| 2,862,750 | 12/1958 | Minke | 292/336.3 X |
| 4,052,092 | 10/1977 | Bergen | 292/244 X |
| 4,276,760 | 7/1981 | Nolin . | |
| 4,333,324 | 6/1982 | Delta et al. . | |
| 4,418,552 | 12/1983 | Nolin . | |
| 4,615,549 | 10/1986 | Couture . | |
| 4,623,174 | 11/1986 | Trull et al. . | |
| 4,711,477 | 12/1987 | Fann et al. . | |
| 4,718,706 | 1/1988 | Fang . | |
| 4,725,085 | 2/1988 | Hu et al. . | |
| 4,750,766 | 6/1988 | Shen . | |
| 4,927,195 | 5/1990 | Wu et al. . | |
| 4,934,800 | 6/1990 | Choi . | |
| 4,982,986 | 1/1991 | Gressett et al. . | |
| 5,060,991 | 10/1991 | Davidian et al. . | |
| 5,088,778 | 2/1992 | Lin . | |
| 5,123,683 | 6/1992 | Solovieff . | |
| 5,169,184 | 12/1992 | Bishop . | |
| 5,257,837 | 11/1993 | Bishop . | |
| 5,354,109 | 10/1994 | Lin . | |

*Primary Examiner*—Rodney M. Lindsey
*Attorney, Agent, or Firm*—Spencer T. Smith

[57] ABSTRACT

An interconnected lockset comprising an upper deadbolt assembly including a rotatable spindle, a turn piece secured to the spindle, the turn piece rotatable from either of two symmetrical unlocked orientations to a locked orientation, and a pinion secured to the turn piece, a lower lever assembly including a rotatable element, an operator secured to the rotatable element, and a cam having opposed arms secured for displacement with the operator, and a rose for supporting the turn piece and the operator, a vertically displaceable rack including a pair of adjacent legs for engagement with the opposed arms, a vertically extending row of rack teeth, the row of teeth rack being selectively located so that the teeth can be either located on one side of the pinion to rotate the turn piece clockwise from one of the unlocked orientations to the neutral locked orientation or located on the other side of the pinion to rotate the turn piece counterclockwise from the other unlocked orientation to the neutral locked orientation.

6 Claims, 5 Drawing Sheets

INTERCONNECTED LOCK

The present invention relates to locks which have an upper deadbolt (auxiliary lock) and a lower lock which are interconnected. The interconnection is to provide a panic feature, i.e., when the operator of the interior lower lock is turned the upper deadbolt will be automatically released.

Interconnected locks have an interior deadbolt turn piece which should be pointed towards a selected location (often marked "locked") when the deadbolt is operated. Since such interconnected locks may be left or right handed, the deadbolt piece should, with either installation, rotate to the correct position pointing to "locked."

The vertical spacing between the upper and lower locks is also not a single distance and prior art mechanisms for carrying out the privacy function are designed forlone vertical spacing (U.S. Pat. No. 4,725,085) and are not easily modified for a different vertical spacing.

It is accordingly an object of the present invention to provide an interconnected lock with a privacy function that is very easily modified to accommodate different vertical spacings.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
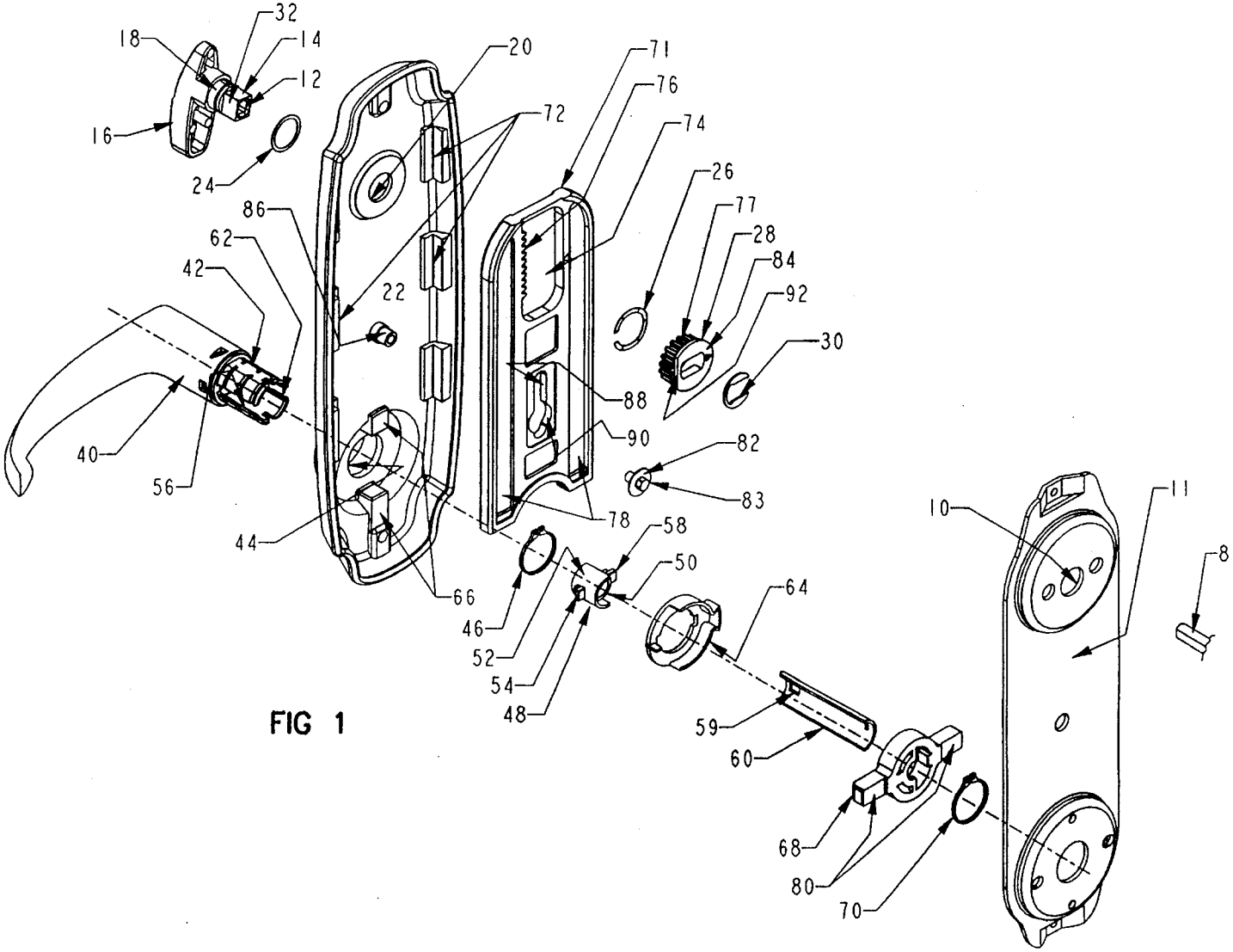
FIG. 1 is an oblique exploded view of the interior portion of an interconnected lockset made in accordance with the teachings of the present invention.

The interior half of an interconnected lockset is shown in FIG. 1. The upper lock is a deadbolt (not shown) which would have a key operated lock on the exterior of the door which would include a D shaped spindle 8 which passes through the door, through a suitable hole 10 in an interior mounting plate 11 and into a suitable hole 12 in the rectangular end 14 of a turn piece 16. The rectangular end 14 is connected to a cylindrical pilot 18 which enters an upper hole 20 in the rose 22 with a washer 24 being located between the turn piece 16 and the rose 22. Located on the rectangular end 14 is a wave spring 26 and a pinion 28 which are fastened in position by a retaining clip 30 which is received by suitable slots 32 in the rectangular end. The bolt of the deadbolt (not shown) can be thrown or retracted either by rotating the turn piece approximately 90° to the illustrated vertical position or by turning the key in the lock which will also result in the positioning of the turn piece at the illustrated vertical locked position.

The lower interior operator could be a simple lever or knob 40 having an insert 42 which extends through the lower rose hole 44 and is retained by a retaining ring 46. A drive locking insert 48 has a cylindrical hub 50 and a semi cylindrical portion 52. A first tab 54 projects radially from the semi cylindrical portion 52 for insertion into one slot 56 of the lever insert and a second tab 58 extends radially outwardly from the cylindrical hub, projects through a hole 59 in a half round 60 and into the opposing slot 62 of the lever insert 42. The half round 60 is connected to the lock mechanism and operates a conventional latch (not shown). The lower lock can therefore be opened either by turning the lever or by turning the key in the lock. To maintain the lever at a horizontal orientation a torque spring (not shown) which is housed by a torque spring housing 64 interconnects with tabs 66 on the rose. The torque spring housing 64 and a cam 68, through which the half round 60 passes, are secured on the lever insert 42 by a retaining clip 70.

Figure 2:
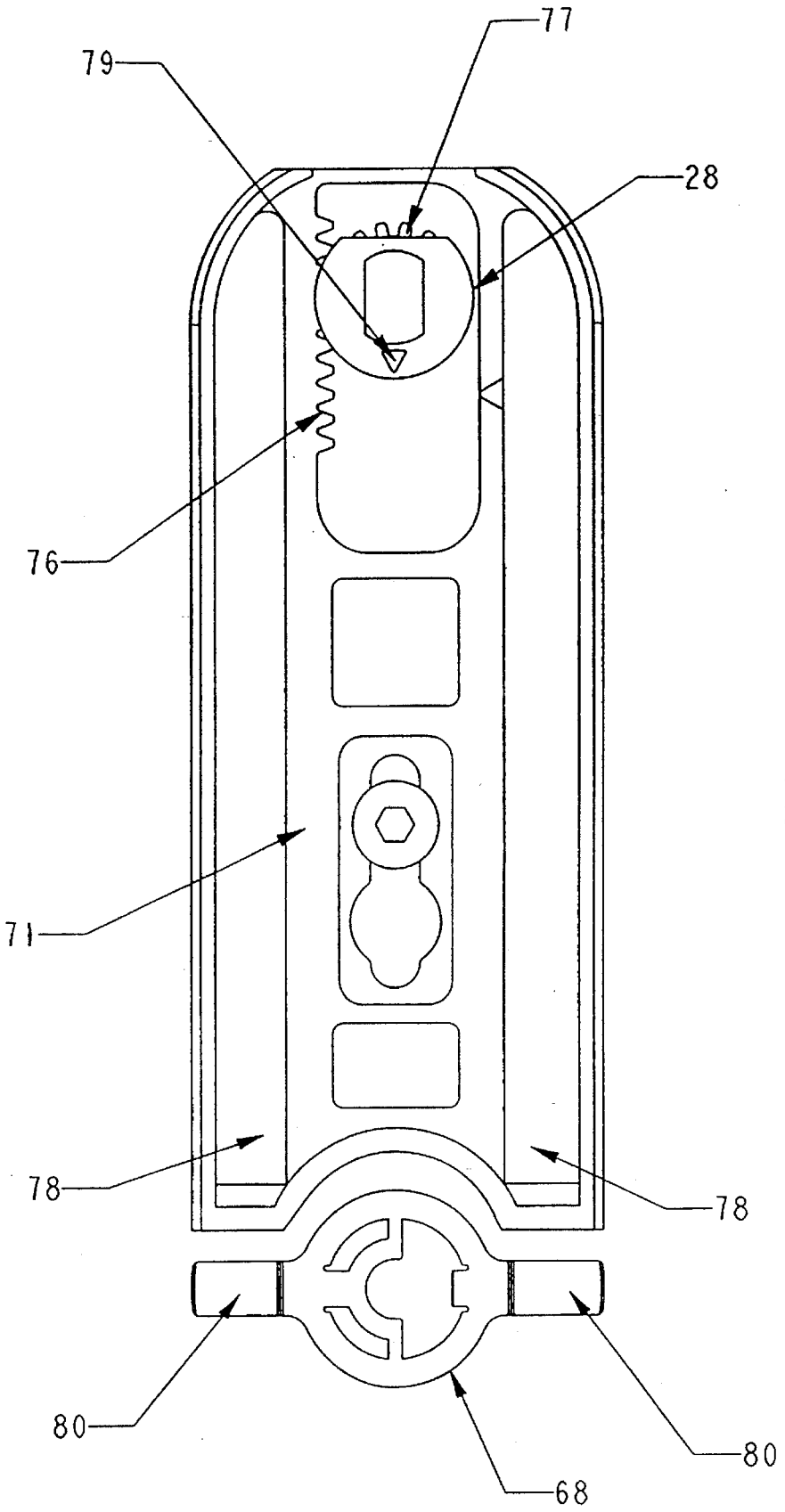
FIG. 2 is a schematic showing of the rack at the thrown deadbolt position.

To retract the deadbolt when the lever is turned in either direction, a deadbolt retraction mechanism is provided which includes a rack 71 which is rectangular in shape and which is slidably received by opposed pairs of rose guides 72 on the rose 22. The rack has an opening 74 at its top which includes vertically extending teeth 76 on one side which engage with the teeth 77 on the pinion 28. The bottom of the rack is defined by a pair of opposed legs 78 which engage the two outwardly projecting arms 80 of the cam when the rack is at its lowest position (FIG. 2) where the turn piece will be located at the locked position (the direction of the turn piece is shown by line 79). Rotation of the lever 40 in either the clockwise or counterclockwise direction will result in one of the cam arms 80 engaging one of the rack legs 78 to drive the rack upwardly to the deadbolt throw orientation (the interior ends of the legs may be beveled to permit continued rotation of the lever following the orientation of the turn piece at the deadbolt release position).

Figure 3:
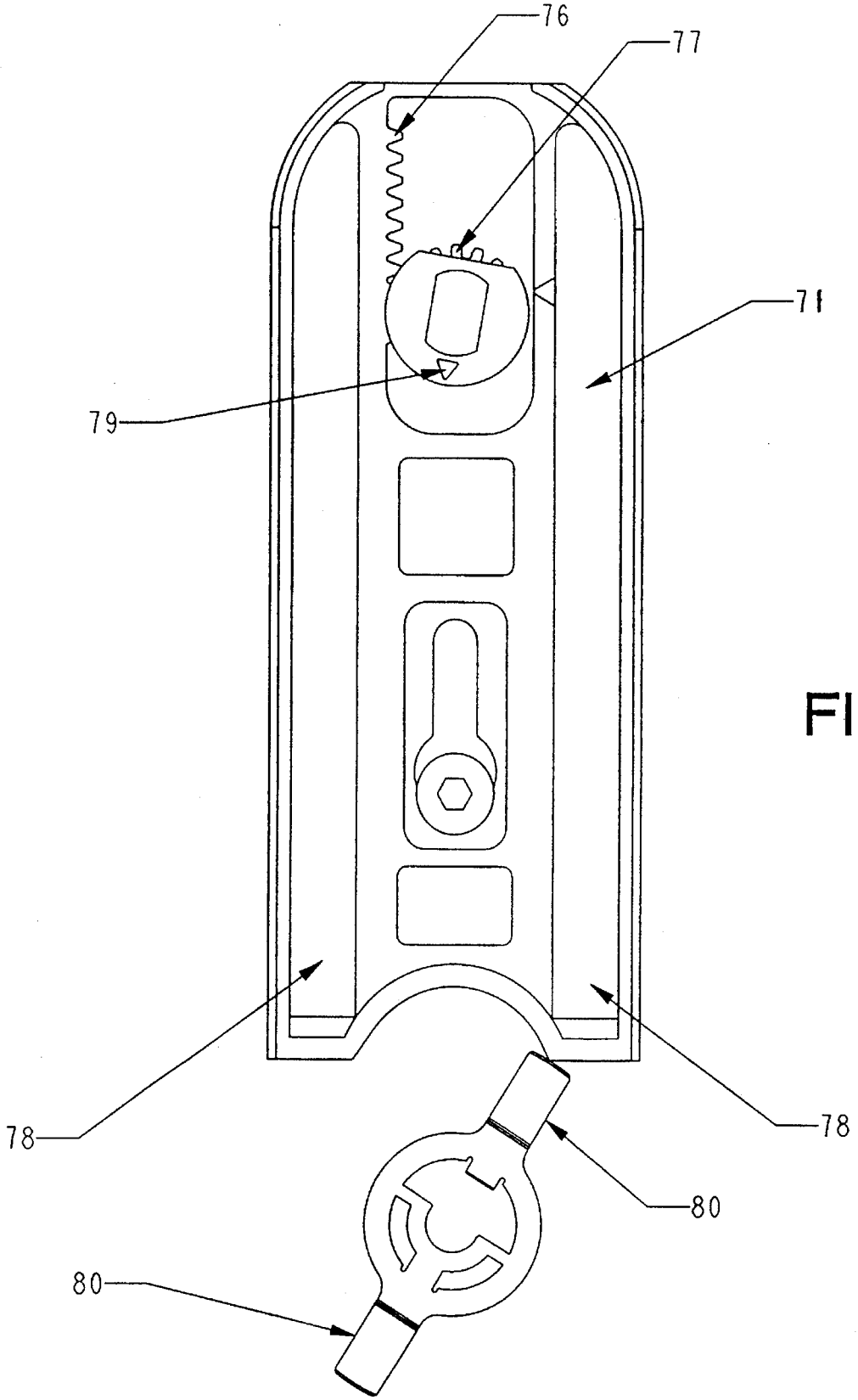
FIG. 3 is a view similar to that of FIG. 2 showing the rack at the bolt retracted position.

When the lever is rotated in either direction to the bolt throw position (rotated approximately 90° from horizontal to vertical), the rack will move to its fully up position (FIG. 3). Line 79 again shows the orientation of the turn piece. At the deadbolt throw and deadbolt retracted positions (FIGS. 2 and 3), removal of the rack is prevented by the circular head 82 of the hold down screw 83 and by the pinion flange 84. (The hold down screw 83 is received by a rose post 86 which is located within a rack slot which has an elongated top portion 88 and a circular portion 90 which is larger than the circular head 82 of the hold down screw).

Figure 4:
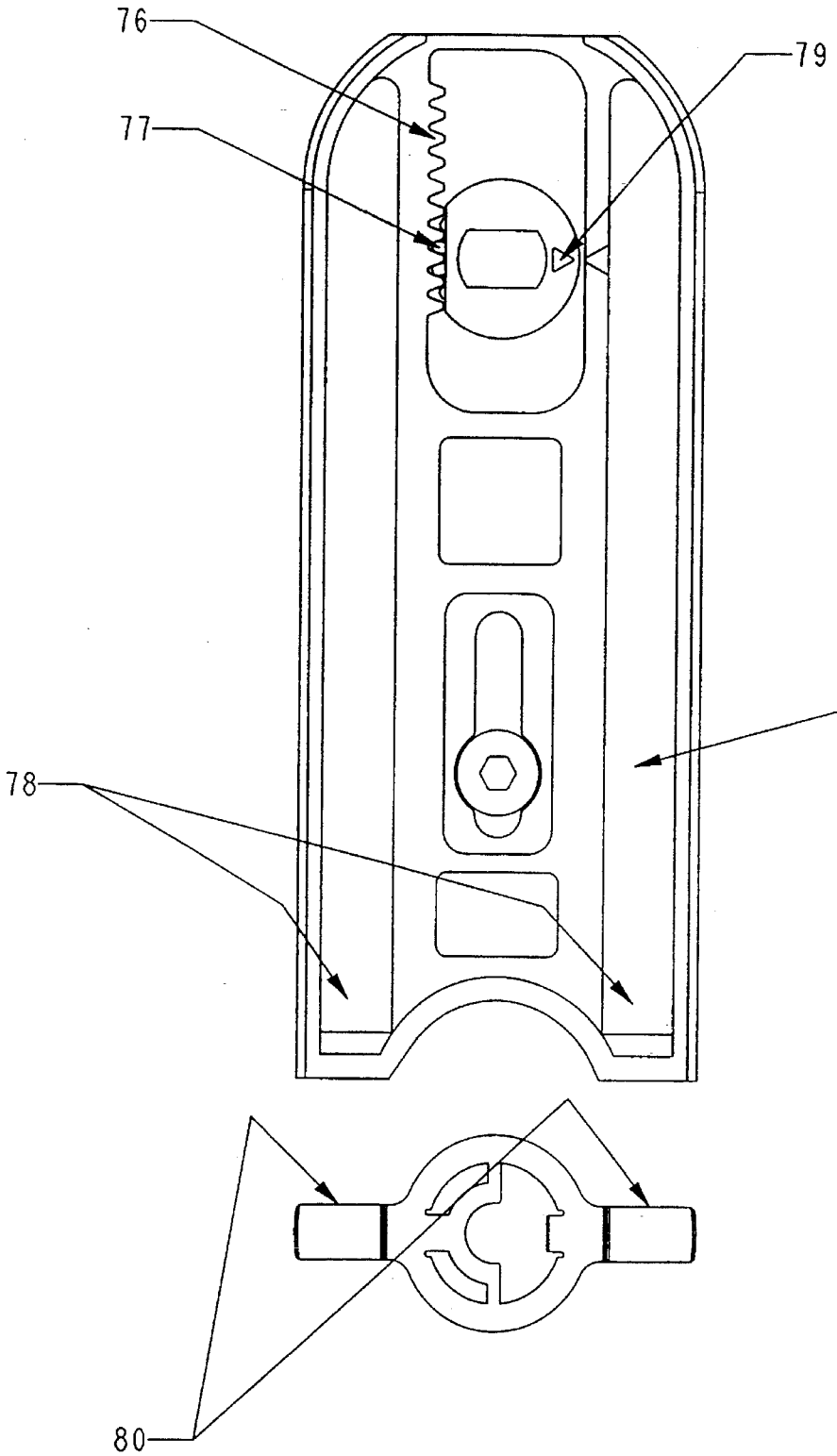
FIG. 4 is a view similar to that of FIG. 2 with the rack at the removal location.
Figure 5:
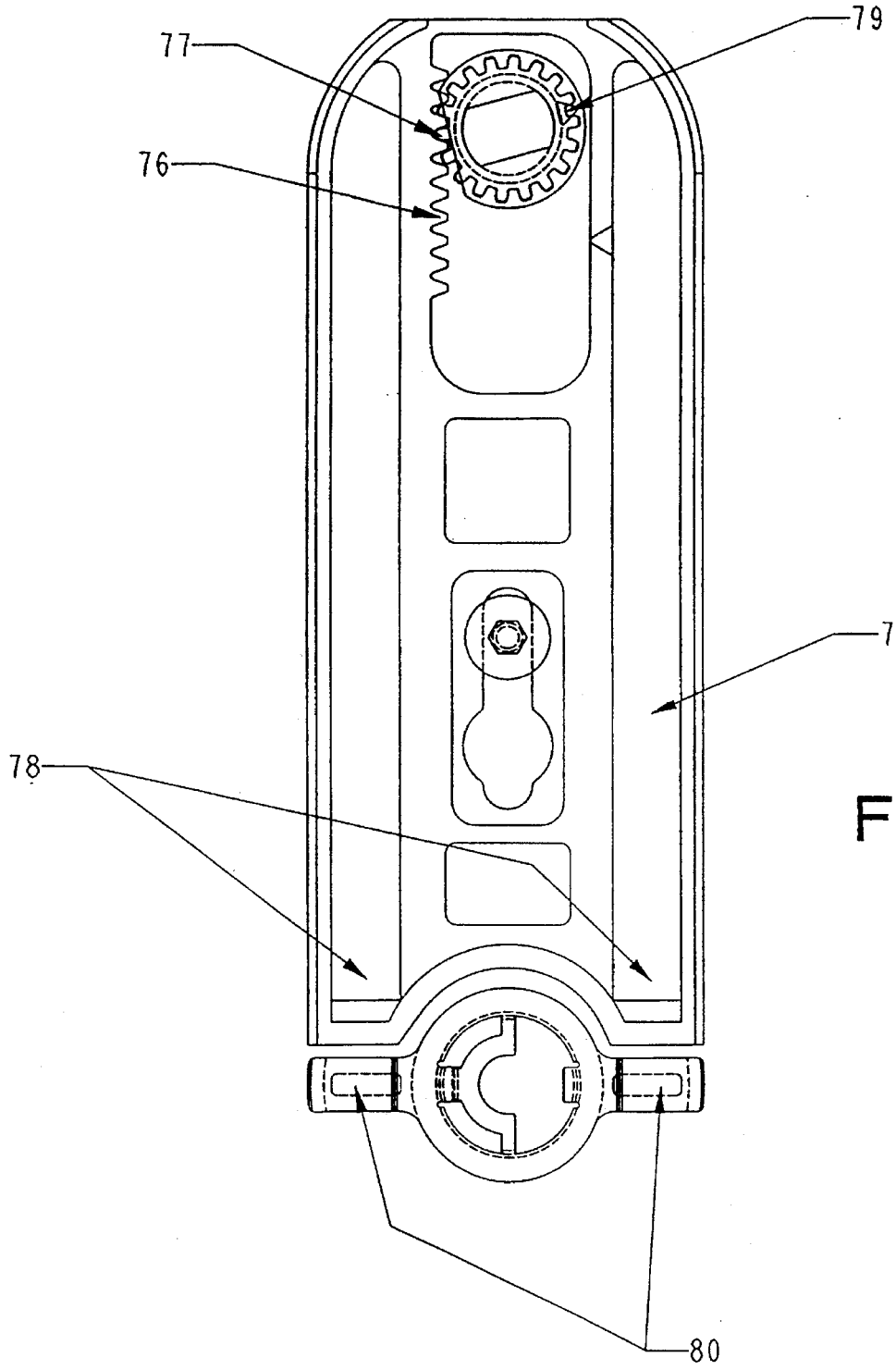
FIG. 5 is a view similar to that of FIG. 2 showing the rack positioned for left handed operation.

When the turn piece is turned horizontal, the hold down screw lies coaxial to a larger hole 90 in the rack and the pinion is oriented with the flat of its cover parallel to the rack so that the rack can be removed. To switch the lever from right hand operation (the lever is shown 180° from its correct orientation in FIG. 1 for purposes of clarity) to left hand operation, the turn piece is oriented to be horizontal (FIG. 4). The head of the hold down screw and the circular portion of the rack slot are now coaxial and the flat edge 92 of the flange 84 is parallel to and spaced from the teeth 76. The rack can now be removed and flipped over and the pinion (and hence the turn piece) can be rotated 180° so that the rack can be replaced in the rose (FIG. 5). Now, the movement of the rack from the deadbolt thrown position to the retracted position will rotate the turn piece 110° clockwise (if facing the inside of the mechanism) instead of approximately 90° counterclockwise and to throw the bolt the turn piece will have to be moved approximately 90° clockwise (facing inside of door outside of mechanism) instead of approximately 90° counterclockwise. With this design the load on the lever throughout its movement to release the bolt will be constant.

While the invention has been disclosed with a simple lever on the interior and a keyed lock which will automatically lock with key removal, other combinations are possible. For example, both the interior and exterior lower operators could be simple levers or the exterior operator could be keyed. Other combinations are also possible.

What is claimed is:

1. An interconnected lockset comprising an upper deadbolt assembly including a rotatable spindle, a turn piece secured to said spindle, said turn piece rotatable from either of two symmetrical unlocked orientations to a locked orientation, and a pinion secured to said turn piece, a lower lever assembly including a rotatable element, an operator secured to said rotatable element, and a cam having opposed arms secured for displacement with said operator, and a rose for supporting said turn piece and said operator, a vertically displaceable rack including a pair of adjacent legs for engagement with said opposed arms, a vertically extending row of rack teeth, said row of rack teeth being selectively located so that said teeth can be either located on one side of said pinion to rotate said turn piece clockwise from one of said unlocked orientations to said neutral locked orientation or located on the other side of said pinion to rotate said turn piece counterclockwise from the other unlocked orientation to said neutral locked orientation.

2. An interconnected lockset according to claim 1, wherein said pinion comprises means for preventing the removal of said rack except at a selected rack location.

3. An interconnected lockset according to claim 2, further comprising an elongated slot including an enlarged cylindrical portion, hold down screw means extending through said slot and including a head selectively sized to pass through said enlarged cylindrical portion of said elongated slot, said enlarged slot portion being selectively located so that said rack can be removed at said selected rack removal location.

4. An interconnected lockset according to claim 3, wherein said selected rack location is at a location between said turn piece locked and turn piece unlocked positions.

5. An interconnected lockset according to claim 4, wherein said turn piece is horizontal at said selected rack locations.

6. An interconnected lockset according to claim 4, wherein said preventing means comprises a cover having a flat edge defined to be locatable parallel to and spaced from said row of teeth when said rack is at said selected rack location.

* * * * *